US009317006B2

(12) United States Patent
Massaro, Jr.

(10) Patent No.: US 9,317,006 B2
(45) Date of Patent: Apr. 19, 2016

(54) LASER PRINT CARTRIDGE WITH REMOVABLE PAPER CLEANING ASSEMBLY

(71) Applicant: Peter Vincent Massaro, Jr., West Haven, CT (US)

(72) Inventor: Peter Vincent Massaro, Jr., West Haven, CT (US)

(73) Assignee: FLO-TECH, LLC, Middletown, CT (US)

( * ) Notice: Subject to any disclaimer, the term of this patent is extended or adjusted under 35 U.S.C. 154(b) by 0 days.

(21) Appl. No.: 14/087,974

(22) Filed: Nov. 22, 2013

(65) Prior Publication Data

US 2015/0147082 A1 May 28, 2015

(51) Int. Cl.
*G03G 21/00* (2006.01)
*G03G 21/16* (2006.01)

(52) U.S. Cl.
CPC ..... *G03G 21/169* (2013.01)

(58) Field of Classification Search
USPC ..... 399/98, 349
See application file for complete search history.

(56) References Cited

U.S. PATENT DOCUMENTS

| | | | | |
|---|---|---|---|---|
| 8,145,110 | B2 * | 3/2012 | Condello | G03G 15/2025 399/323 |
| 2003/0156869 | A1 * | 8/2003 | Karakama et al. | 399/350 |
| 2004/0013446 | A1 * | 1/2004 | Morioka et al. | 399/111 |
| 2008/0260438 | A1 * | 10/2008 | Uda et al. | 399/346 |
| 2009/0304407 | A1 * | 12/2009 | Thayer et al. | 399/71 |
| 2011/0103810 | A1 * | 5/2011 | Yoshida | 399/27 |
| 2011/0211883 | A1 * | 9/2011 | Ferrar et al. | 399/350 |
| 2012/0321364 | A1 * | 12/2012 | Wakayama | 399/357 |

* cited by examiner

*Primary Examiner* — David Gray
*Assistant Examiner* — Tyler Hardman
(74) *Attorney, Agent, or Firm* — Bachman & LaPointe, P.C.

(57) ABSTRACT

An improved laser print cartridge having a reduced defect rate. The improved laser print cartridge includes a printing assembly, a primary cleaning assembly, and a paper cleaning assembly. The printing assembly includes a drum, a primary charge roller, and a toner roller for applying toner to printer paper. The primary cleaning assembly includes a wiper blade for removing large debris particles from the drum into a large particle receiving volume. The paper cleaning assembly provides a wicking flange for removing smaller particles of debris not removed by the wiper blade. As such, the wicking flange is positioned in between the wiper blade and the primary charge roller and is mounted to the wiper blade. A cleaning portion of the wicking flange is pressed against the drum and either absorbs the debris or wipes the debris into a small particle receiving volume delineated by the drum, wicking flange, and wiper blade.

13 Claims, 10 Drawing Sheets

LASER PRINT CARTRIDGE WITH REMOVABLE PAPER CLEANING ASSEMBLY

FIELD OF THE INVENTION

The present invention relates generally to printers. More specifically, the present invention is an improved laser print cartridge for reducing the defect rate in printed pages. Furthermore, the present invention provides a paper cleaning assembly for removing paper dust and other debris from the drum of the printer cartridge.

BACKGROUND OF THE INVENTION

Traditional laser print cartridges comprise a drum, a primary charge roller, a toner roller, a recovery blade, a wiper blade, and a waste bin. In order to print, the drum is either positively or negatively charged by the primary charge roller. A laser assembly within the printer is then used to discharge select regions of the drum in order to form the desired image. Toner having a charge opposite that of the drum is then dispersed onto the drum from the toner roller. As paper passes between the transfer roller of the printer and the drum, the toner is applied to the printer paper. As the drum continues to rotate, residual toner and any other debris is removed by the wiper blade. The removed toner and debris is then deposited into the waste bin, while the recovery blade assists in retaining the removed toner and debris within the waste bin.

However, laser print cartridges have been known to defect, resulting in a repetitive and unwanted image being printed down the printer paper. This defect is most commonly caused by the formation of one or more spots on the primary charge roller. These spots are often a result of paper dust, calcium carbonate, or kaolin clay that has not been removed from the drum by the wiper blade. When this debris is not removed by the wiper blade, the debris is compressed between the drum and the primary charge roller and as a result sticks to the primary charge roller. Resultantly, the area of the primary charge roller covered in debris is insulated and will not act to charge the drum as it passes by, thus causing toner to be attracted to the uncharged portion of the drum and creating unwanted toner marks down the page.

This defect is most prevalent in the legal and medical industries, in which heavy bond paper is most often used in place of regular printer paper. Due to the composition of the heavy bond paper, more paper dust is generated when the heavy bond paper passes between the drum and transfer roller as compared to normal printer paper. Because there is an increase in the production of paper dust, there is an increased chance for paper dust particles to pass by the wiper blade and get pressed into the primary charge roller. Resultantly, the increased volume of paper dust particles leads to an increased defect rate in the laser print cartridge.

Therefore it is the object of the present invention to provide an improved laser print cartridge having a paper cleaning assembly. In addition to the paper cleaning assembly, the improved laser print cartridge provides a printing assembly and a primary cleaning assembly. The printing assembly includes a drum, a primary charge roller, and a toner roller for applying toner to printer paper. The primary cleaning assembly includes a wiper blade for removing large particles of debris from the drum, while the paper cleaning assembly includes a wicking flange for removing smaller particles that may pass by the wiper blade. As such, the wicking flange is positioned in between the wiper blade and the primary charge roller and is mounted to the wiper blade. A cleaning portion of the wicking flange is pressed against the drum and acts to remove the residual debris not removed by the wiper blade. Together the drum, the wiper blade, and the wicking flange delineate a waste receiving volume where debris that is removed from the drum by the wicking flange is deposited. Field tests using the present invention have been shown to reduce the printing defect rate from 23.1% to 2.2%.

DETAIL DESCRIPTIONS OF THE INVENTION

All illustrations of the drawings are for the purpose of describing selected versions of the present invention and are not intended to limit the scope of the present invention.

The present invention is an improved laser print cartridge having a reduced defection rate compared to that of current laser print cartridges. The improved laser print cartridge comprises a cartridge casing 1, a printing assembly 2, a primary cleaning assembly 3, and a paper cleaning assembly 4. The cartridge casing 1 provides a housing for the printing assembly 2, the primary cleaning assembly 3, and the paper cleaning assembly 4. The primary cleaning assembly 3 and the paper cleaning assembly 4 are used to clean the printing assembly 2 of any residual toner or debris after the printing assembly 2 has applied toner to a page of printer paper. The primary cleaning system is designed to remove large particles of debris from the printing assembly 2, while the paper cleaning assembly 4 is designed to remove smaller particles of debris that may not be removed by the primary cleaning assembly 3.

Figure 1:
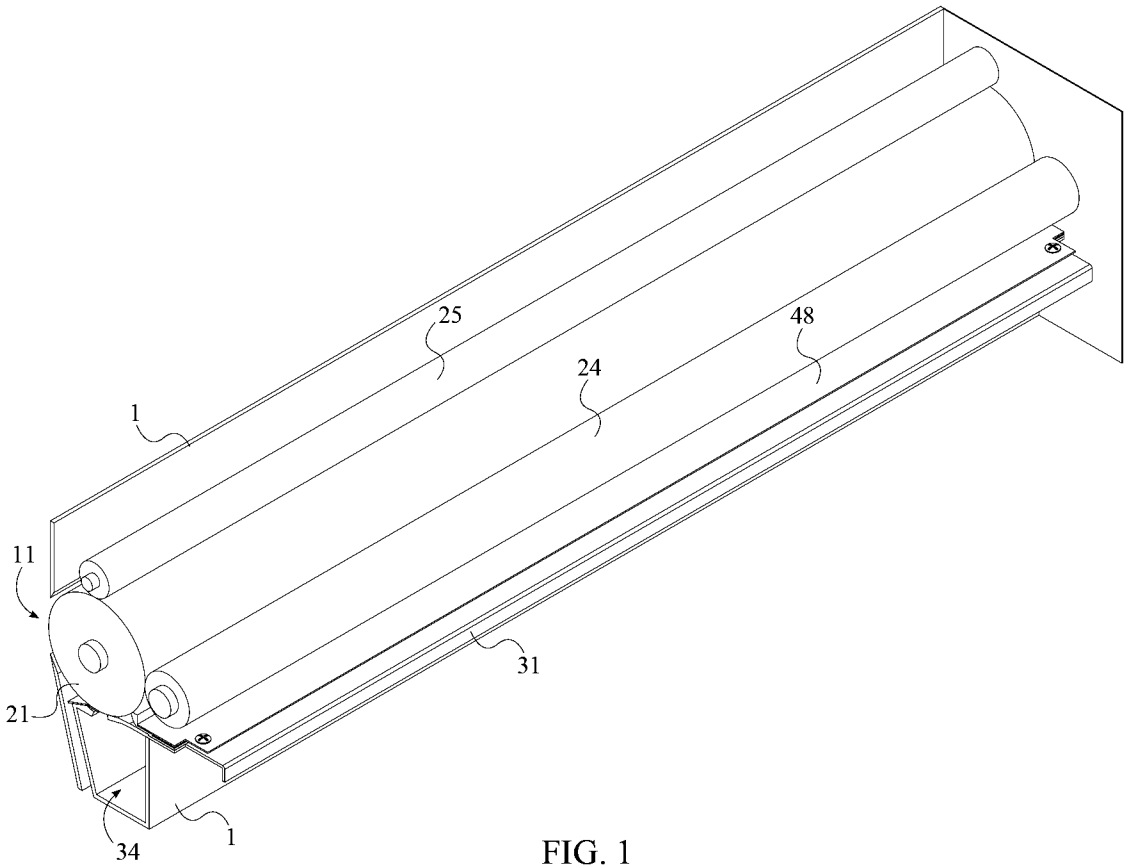
FIG. 1 is a rear perspective view of the present invention showing only a section of the cartridge casing.
Figure 2:
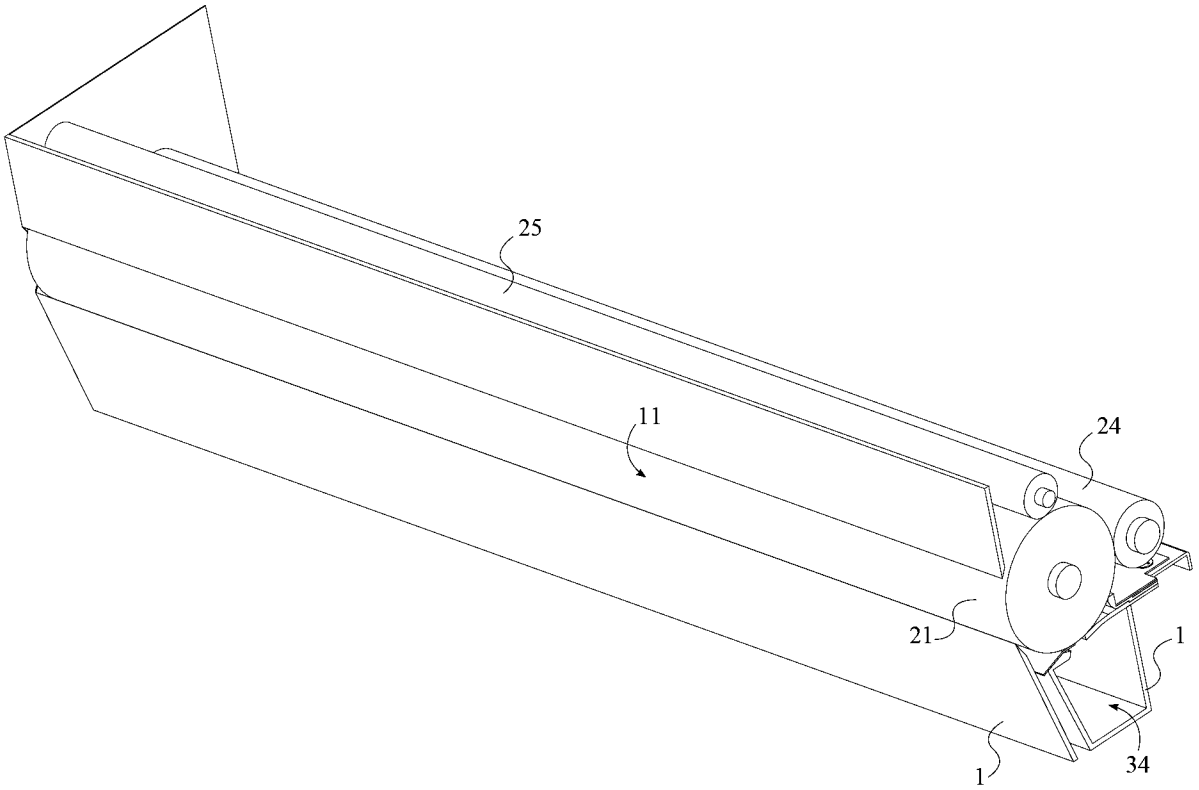
FIG. 2 is a front perspective view of the present invention showing only a section of the cartridge casing.

In reference to FIG. 1-2, the printing assembly 2 is used to apply toner to a page of printer paper and comprises a drum 21, a primary charge roller 24, and a toner roller 25. The drum 21, the primary charge roller 24, and the toner roller 25 are rotatably mounted within the cartridge casing 1, with both the primary charge roller 24 and the toner roller 25 tangentially engaging the drum 21. Any of the drum 21, the primary charge roller 24, or the toner roller 25 may be mounted directly to the cartridge casing 1 or indirectly through additional mounting structures. The drum 21 is an elongated cylinder that is coated in a photosensitive material, such that select regions of the drum 21 can be charged or discharged. The primary charge roller 24 is an elongated cylinder through which an electrical current is run in order to provide the primary charge roller 24 with either a positive or negative charge. The toner roller 25 comprises an elongated hollow cylinder and a magnet that is positioned within the hollow cylinder. The hollow cylinder is constructed form a non-magnetic material, such that charged toner is attracted to the hollow cylinder, yet can readily be deposited onto a page of printer paper.

Figure 3:
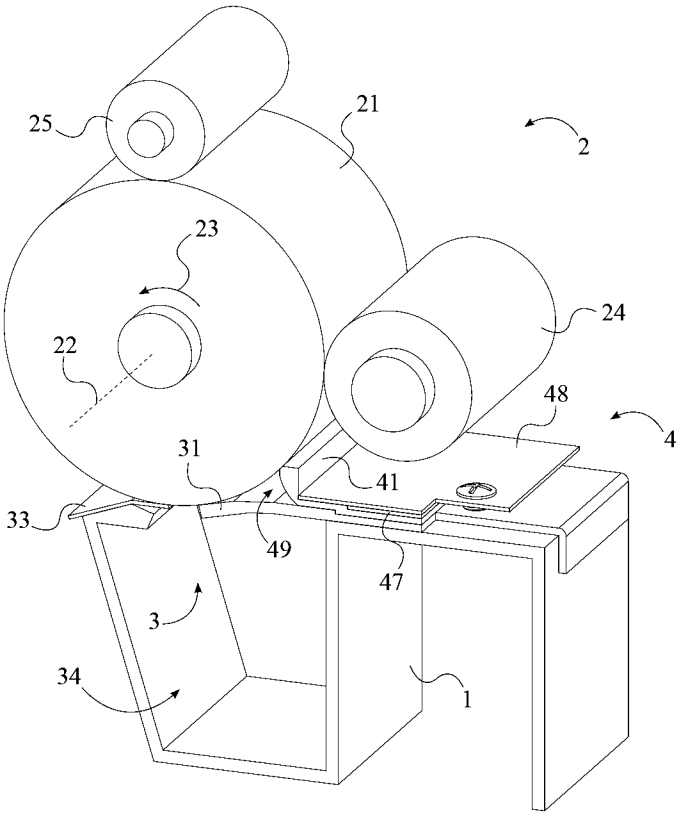
FIG. 3 is a perspective sectional view of the printing assembly, primary cleaning assembly, and paper cleaning assembly.

In reference to FIG. 3-4, in order to complete a print cycle, the printing assembly 2, the primary cleaning assembly 3, and the paper cleaning assembly 4 are configured in the following manner within the cartridge casing 1. The primary charge roller 24, the toner roller 25, the primary cleaning assembly 3, and the paper cleaning assembly 4 are radially positioned around the drum 21; the toner roller 25 being radially positioned in between the primary charge roller 24 and the primary cleaning assembly 3; the primary cleaning assembly 3 being positioned in between the toner roller 25 and the paper cleaning assembly 4; the paper cleaning assembly 4 being positioned in between the primary cleaning assembly 3 and the primary charge roller 24. The drum 21 comprises a rotation axis 22 and a direction of rotation 23. The rotation axis 22 is centrally positioned along the drum 21, while the direction of rotation 23 revolves around the rotation axis 22. The direction of rotation 23 traverses from the primary cleaning assembly 3 to the paper cleaning assembly 4 to the primary charge roller 24.

Figure 4:
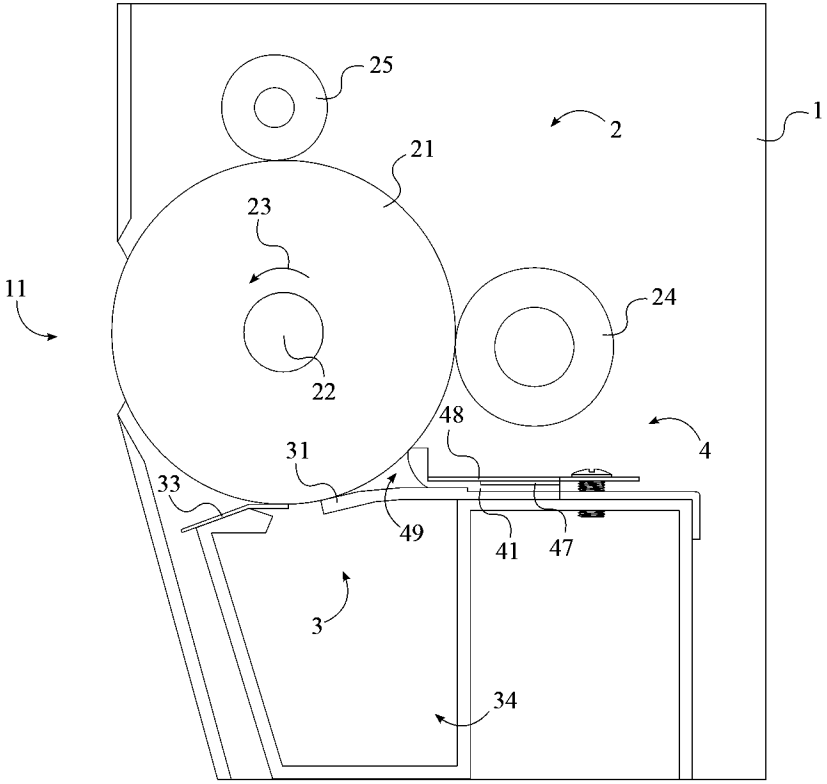
FIG. 4 is a right side elevational view of the present invention showing only a section of the cartridge casing.

In reference to FIG. 4, the cartridge casing 1 comprises a case opening 11. The case opening 11 is positioned adjacent to the drum 21, such that the drum 21 partially extends out of the cartridge casing 1. The case opening 11 is radially positioned in between the toner roller 25 and the primary cleaning assembly 3 about the drum 21. In this way, a section of the drum 21 rotates past the toner roller 25, picking up the charged toner, and then rotates through the case opening 11, where the section of the drum 21 that is covered in toner comes in contact with the printer paper. The toner is then deposited onto the printer paper. As the section of the drum 21 continues to rotate back into the cartridge casing 1, residual toner and debris is first removed by the primary cleaning assembly 3 and then by the paper cleaning assembly 4.

In further reference to FIG. 4, the primary cleaning assembly 3 comprises a recovery blade 33 and a wiper blade 31. Both the recovery blade 33 and the wiper blade 31 are connected to the cartridge casing 1 and engage the drum 21. More specifically, the wiper blade 31 comprises a leading edge 32 that engages the drum 21. The wiper blade 31 is positioned in between the recovery blade 33 and the paper cleaning assembly 4, such that as the drum 21 rotates in the direction of rotation 23, residual toner and other debris first passes over the recovery blade 33 and then comes in contact with the leading edge 32 of the wiper blade 31. Together, the cartridge casing 1, the drum 21, the recovery blade 33, and the wiper blade 31 delineate a large particle receiving volume 34. As residual toner and debris come in contact with the leading edge 32 of the wiper blade 31, the residual toner and debris is removed from the drum 21 and deposited into the large particle receiving volume 34. The recovery blade 33 prevents any removed toner or debris from inadvertently being expelled from the large particle receiving volume 34.

Figure 6:
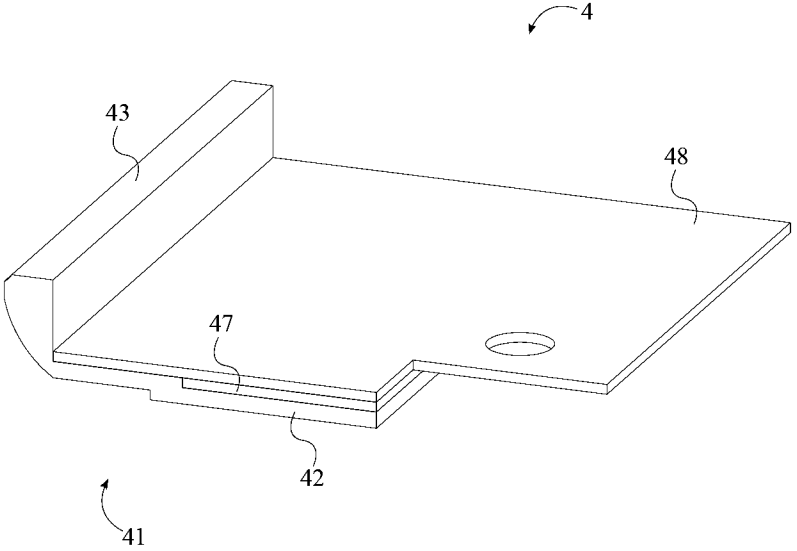
FIG. 6 is a perspective sectional view of the paper cleaning assembly.
Figure 7:
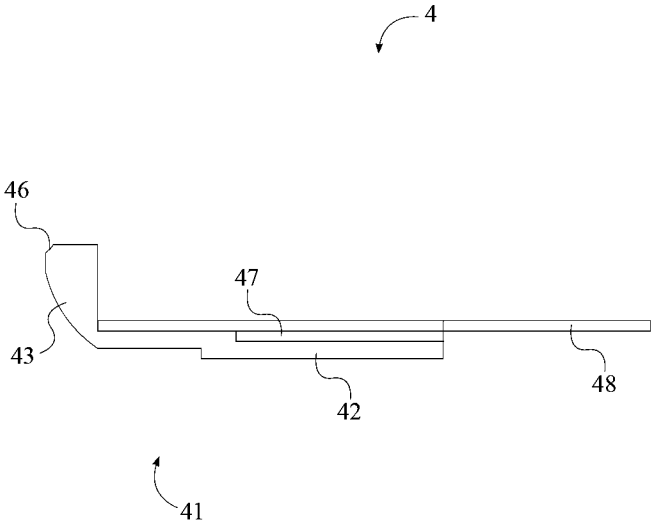
FIG. 7 is a right side elevational view of the paper cleaning assembly.

In reference to FIG. 6-7, the paper cleaning assembly 4 comprises a wicking flange 41, an adhesive strip 47, and a flange stop 48. The adhesive strip 47 is positioned in between the wicking flange 41 and the flange stop 48, and comprises a first adhesive surface and a second adhesive surface. The first adhesive surface and the second adhesive surface are positioned along the adhesive strip 47 and on opposite sides of the adhesive strip 47. In this way, the wicking flange 41 is attached to the flange stop 48 by the adhesive strip 47. The flange stop 48 is a rigid structure and is attached to the wiper blade 31 with the wicking flange 41 positioned on the wiper blade 31, such that the wicking flange 41 is compressed between the wiper blade 31 and the flange stop 48 and held in place against the drum 21.

Figure 5:
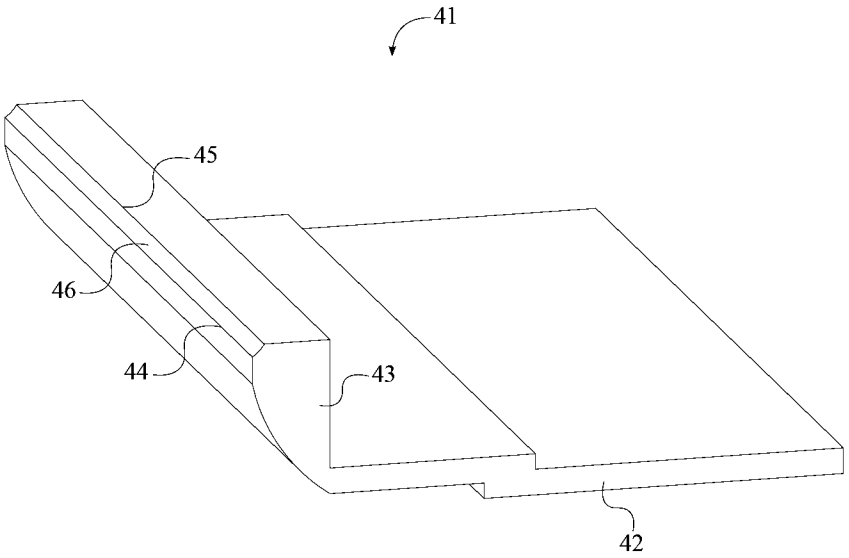
FIG. 5 is a perspective sectional view of the wicking flange.

In reference to FIG. 5, the wicking flange 41 comprises a mounting portion 42 and a cleaning portion 43, the mounting portion 42 and the cleaning portion 43 being positioned adjacent to each other. The mounting portion 42 provides the section of material that is used to attach the wicking flange 41 to the flange stop 48. The adhesive strip 47 is positioned in between the mounting portion 42 and the flange stop 48 and, in this way, the mounting portion 42 is attached to the flange stop 48 by the adhesive strip 47. While the mounting portion 42 is secured between the wiper blade 31 and the flange stop 48, the cleaning portion 43 engages the drum 21 in order to remove leftover debris not removed by the primary cleaning assembly 3. More specifically, the cleaning portion 43 comprises a proximal edge 44, a distal edge 45, and a cleaning surface 46, the cleaning surface 46 being the section of the cleaning portion 43 that engages the drum 21. The proximal edge 44 and the distal edge 45 are parallel to each other, with the cleaning surface 46 being positioned in between the proximal edge 44 and the distal edge 45.

Together, the drum 21, the wicking flange 41, and the wiper blade 31 delineate a small particle receiving volume 49, as shown in FIG. 4. As debris comes in contact with the proximal edge 44, any small particles of debris not removed by the wiper blade 31 are wicked off of the drum 21 and deposited into the small particle receiving volume 49. The cleaning surface 46 remains in contact with the drum 21 and acts to wick away any debris that may happen to pass the proximal edge 44. In the preferred embodiment of the present invention, the wicking flange 41 is constructed from a hydrophilic polyurethane foam that acts to wipe debris away from the drum 21 into the small particle receiving volume 49 or absorb the debris. It is also possible for the wicking flange 41 to be constructed using any other material(s) having similar wiping/wicking properties.

Figure 8:
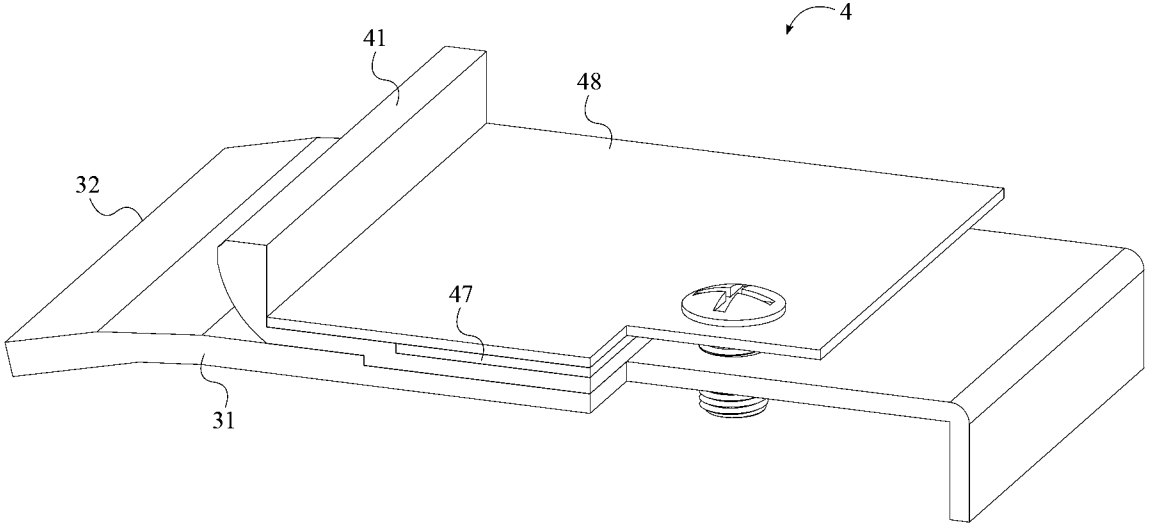
FIG. 8 is a perspective sectional view of the paper cleaning assembly attached to the wiper blade.
Figure 9:
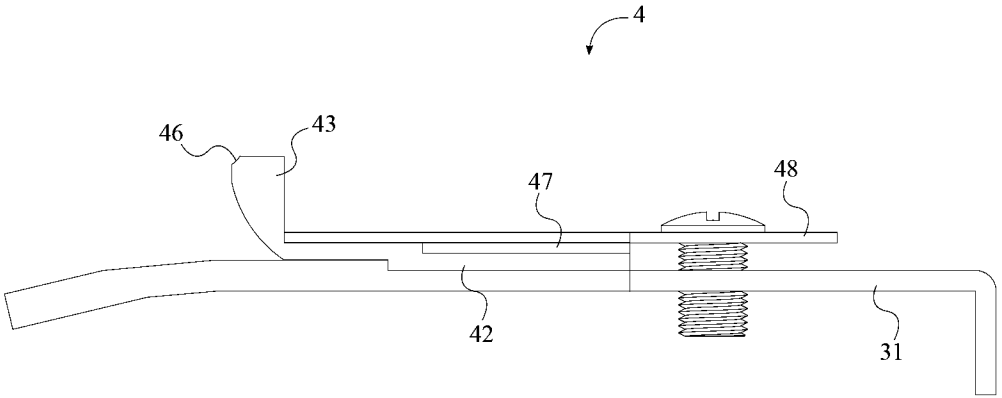
FIG. 9 is a right side elevational view of the paper cleaning assembly attached to the wiper blade.

In the preferred embodiment of the present invention, screws are positioned through the flange stop 48 and into the wiper blade 31, as depicted in FIG. 8-9. In this way, the paper cleaning assembly 4 can be removed in order to maintenance the present invention. The detachment of the paper cleaning assembly 4 allows the small particle receiving volume 49 to be emptied if necessary. Additionally, the adhesive strip 47 allows the wicking flange 41 to be removed from the flange stop 48 and cleaned or replaced in the event that the wicking flange 41 becomes fully saturated. It is also possible for the paper cleaning assembly 4 to be attached to the wiper blade 31 or cartridge casing 1 in any other way.

Figure 10:
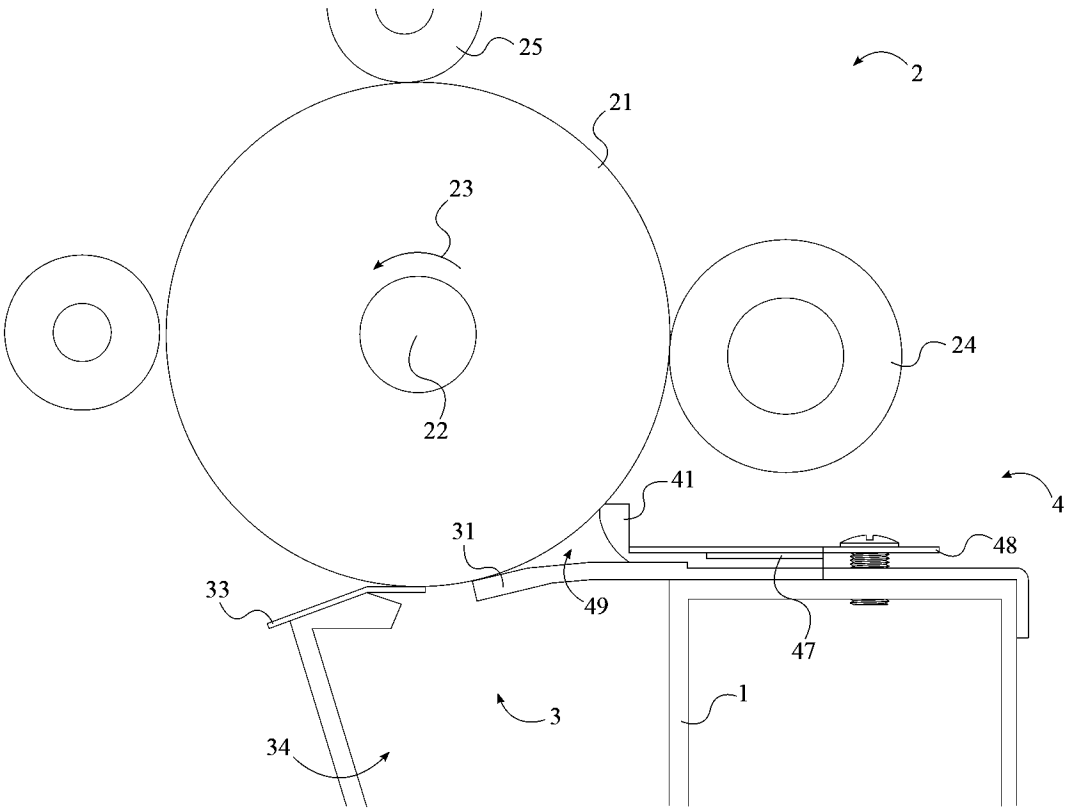
FIG. 10 is a diagram depicting a print cycle of the present invention, in which residual toner and debris are collected within the large particle receiving volume and the small particle receiving volume.

In reference to FIG. 10, when a print cycle is initiated, the primary charge roller 24 is first given a positive charge by running an electrical current through the primary charge roller 24. As the drum 21 rotates about the rotation axis 22, past the primary charge roller 24, the drum 21 is given a positive charge along the point of contact between the drum 21 and the primary charge roller 24. A laser beam inside the printer is then projected onto the drum 21 in order to discharge certain sections of the drum 21, thus forming the desired image to be printed. The drum 21 then rotates past the toner roller 25, where toner is applied to the drum 21 along the point of contact between the drum 21 and the toner roller 25. The toner is stored in a toner reservoir within the cartridge casing 1 and is given a positive charge, such that the positively charged toner on the toner roller 25 is attracted to the negative discharged sections of the drum 21. With the toner applied, the drum 21 then rotates past the cartridge opening, where the toner is applied to printed paper that is passed between the drum 21 and the transfer roller in the printer. Residual toner and any debris picked up from the printer paper is then wiped off of the drum 21 by the wiper blade 31 and deposited into the large particle receiving volume 34 as the drum 21 rotates past the primary cleaning assembly 3. Any finer particles not removed by the primary cleaning assembly 3 are subsequently removed from the drum 21 by the wicking flange 41 and deposited into the small particle receiving volume 49 or absorbed by the wicking flange 41 as the drum 21 rotates past the paper cleaning assembly 4. The cycle is then repeated as necessary to create the full printed image. It is also possible for the print cycle to be carried out with the applied electrical charges being reversed.

Although the invention has been explained in relation to its preferred embodiment, it is to be understood that many other possible modifications and variations can be made without departing from the spirit and scope of the invention as hereinafter claimed.

What is claimed is:

1. A printer cartridge comprising:

a cartridge casing;

a printing assembly including a drum, a primary charge roller, and a toner roller;

a primary cleaning assembly for removing large particles of debris from said drum;

said primary cleaning assembly including a wiper blade;

a paper cleaning assembly for removing small particles of debris from said drum;

said paper cleaning assembly comprising a wicking flange attached to a flange stop by an adhesive strip positioned between the wicking flange and the flange stop; and said wicking flange being attached to and positioned on said wiper blade via said flange stop so that said wicking flange is positioned against said drum for removal of said small particles of debris from said drum.

2. The printer cartridge of claim 1, further comprising:

said primary cleaning assembly further including a recovery blade, and a large receiving volume delineated by said recovery blade and said wiper blade; and said recovery blade preventing any removed toner and debris from being expelled from the large receiving volume.

3. The printer cartridge of claim 1, further comprising said drum, said wicking flange, and said wiper blade delineating a small receiving volume for said small particles of debris.

4. The printer cartridge of claim 1, further comprising said wicking flange wicking said small particles of debris from said drum.

5. The printer cartridge of claim 4, wherein said wicking flange is formed from a hydrophilic polyurethane foam for wiping debris away from the drum.

6. The printer cartridge of claim 3, wherein said wicking flange is joined to said wiper blade via screws positioned through the flange stop into the wiper blade, whereby the paper cleaning assembly can be removed from the wiper blade to allow the small receiving volume to be emptied.

7. The printer cartridge of claim 1, wherein the wicking flange has a cleaning portion formed by a proximal edge, a distal edge, and an angled cleaning surface positioned between the proximal edge and the distal edge.

8. The printer cartridge of claim 7, wherein the wicking flange further has a mounting portion on which said adhesive strip is positioned.

9. The printer cartridge of claim 4, wherein said wicking flange is formed from a material that absorbs debris from the drum.

10. A printer cartridge comprising:

a cartridge casing;

a printing assembly including a drum, a primary charge roller, and a toner roller;

a primary cleaning assembly for removing large particles of debris from said drum;

said primary cleaning assembly including a wiper blade;

a paper cleaning assembly for removing small particles of debris from said drum;

said paper cleaning assembly comprising a wicking flange attached to a flange stop by an adhesive strip positioned in between the wicking flange and the flange stop;

said wicking flange being attached to and removably positioned on said wiper blade via said flange stop; and said primary charge roller being located between said toner roller and said paper cleaning assembly.

11. The printer cartridge of claim 10, further comprising:

a case opening; and said toner roller being located between said primary charge roller and said case opening.

12. The printing cartridge of claim 11, further comprising said primary charge roller and said toner roller abutting said drum.

13. A printer cartridge comprising:

a cartridge casing;

a printing assembly including a drum, a primary charge roller, and a toner roller;

a primary cleaning assembly for removing large particles of debris from said drum;

said primary cleaning assembly including a wiper blade, a recovery blade, and a large receiving volume for receiving said large particles of debris removed from said drum;

said large receiving volume having an opening positioned between said recovery blade and said wiper blade;

a paper cleaning assembly for removing small particles of debris from said drum;

said paper cleaning assembly comprising a wicking flange; and said wicking flange being removably attached to said wiper blade to enable access to a small receiving volume for small particles of debris.

* * * * *